US010714278B2

(12) United States Patent
Wu et al.

(10) Patent No.: US 10,714,278 B2
(45) Date of Patent: Jul. 14, 2020

(54) SWITCH DEVICE STRUCTURE

(71) Applicants: SWITCHLAB INC., New Taipei (TW); SWITCHLAB (SHANGHAI) CO., LTD., Shanghai (CN)

(72) Inventors: Chih-Yuan Wu, New Taipei (TW); Chih Kun Hsiao, New Taipei (TW)

(73) Assignees: Switchlab Inc., New Taipei (TW); Switchlab (Shanghai) Co., Ltd., Shanghai (CN)

( * ) Notice: Subject to any disclaimer, the term of this patent is extended or adjusted under 35 U.S.C. 154(b) by 43 days.

(21) Appl. No.: 16/214,376

(22) Filed: Dec. 10, 2018

(65) Prior Publication Data

US 2019/0189371 A1 Jun. 20, 2019

(30) Foreign Application Priority Data

Dec. 15, 2017 (TW) ..... 106218655 U

(51) Int. Cl.

| | |
|---|---|
| ***H01H 3/10*** | (2006.01) |
| ***H01H 13/14*** | (2006.01) |
| ***H01H 3/02*** | (2006.01) |
| ***H01H 13/10*** | (2006.01) |
| ***H01H 13/50*** | (2006.01) |

(52) U.S. Cl.

CPC ..... *H01H 13/14* (2013.01); *H01H 3/022* (2013.01); *H01H 13/10* (2013.01); *H01H 13/50* (2013.01); *H01H 2003/0246* (2013.01); *H01H 2205/004* (2013.01); *H01H 2235/018* (2013.01)

(58) Field of Classification Search

CPC ..... H01H 13/14; H01H 13/10; H01H 13/50; H01H 2003/0246; H01H 2205/004; H01H 2235/018; H01H 3/022; H01H 9/16; H01H 25/065; H01H 2219/0622; H01H 2235/004; H01H 2219/036; H01H 19/6355; H01H 2003/024; H01H 2221/066; H01H 3/001; H01H 13/62; H01H 1/205; H01H 1/2083; H01H 2003/145; H01H 9/22; G05G 1/015; G05G 5/05; G05G 1/025; G05G 5/04

See application file for complete search history.

(56) References Cited

U.S. PATENT DOCUMENTS 6,198,058 B1 * 3/2001 Graninger ..... H01H 13/02 200/16 R
7,232,965 B2 * 6/2007 Gibbons ..... H01H 3/46 200/17 R (Continued)

*Primary Examiner* — Ahmed M Saeed
(74) *Attorney, Agent, or Firm* — Rosenberg, Klein & Lee

(57) ABSTRACT

A switch device structure provides an ensuring system to improve the shortcoming of the conventional switch device. The switch device structure includes a main body and an operation button assembled with the main body. The main body defines a chamber in which a base seat is assembled. An operation body and a wire connection module are disposed on the base seat. The base seat is formed with a cavity in which an elastic unit is mounted. The elastic unit includes a fixed section and a free section. In response to the move of the operation body and with the fixed section serving as a fulcrum, the free section of the elastic unit can push a second contact of the wire connection module into contact with a first contact to close the circuit or away from the first contact to open the circuit.

38 Claims, 4 Drawing Sheets

(56) References Cited

U.S. PATENT DOCUMENTS

| | | | | |
|---|---|---|---|---|
| 2012/0152713 | A1* | 6/2012 | Orricio | H01H 13/18<br>200/447 |
| 2016/0196933 | A1* | 7/2016 | Wiese | H01H 3/022<br>200/341 |
| 2017/0213672 | A1* | 7/2017 | Shimoyama | H01H 3/022 |

* cited by examiner

SWITCH DEVICE STRUCTURE

BACKGROUND OF THE INVENTION

1. Field of the Invention

The present invention relates generally to an improved switch device structure, and more particularly to a switch device structure including a main body and a base seat assembled with the main body. An elastic unit is mounted on the base seat to ensure that the circuit is closed and/or opened by the switch device.

2. Description of the Related Art

A conventional switch device is applied to an electrical, electronic and automatic control system for an operator to operate the machine or power on/off the system. Such switch device also can serve as an emergency switch. In the case that an operator improperly operates the machine or the equipment fails or the like, the operator can emergently open the circuit to power off the system so as to avoid serious damage or loss.

The conventional emergency switch device generally includes an operation button equipped with a pushbutton and/or rotary switch and a case for receiving the operation button and springs. A connection seat (or base seat), a wire connection module having a contact arm and the like components are assembled in the case. When an operator presses the operation button to drive and press down the connection seat, the case relatively force the connection seat to compress the springs, whereby the springs push out the connection seat to locate the same. Under such circumstance, the connection seat pushes and presses the wire connection module to open the circuit. Moreover, the operator can forcedly pull up the operation button and the connection seat, whereby the connection seat can restore to its home assembling position. In this case, the circuit of the wire connection module is closed again.

The conventional switch device has numerous components and relatively complicated structure so that the manufacturing and assembling cost of the conventional switch device is higher. In order to improve the above problems of the conventional switch device, another conventional switch device has been developed, which employs the contact arm of the wire connection module to provide elastic action force so as to close and/or open the circuit of the switch. In the operation switch, a spiral spring is disposed between the switch case and the slide body and the cooperative wire connection module has a first leaf spring and a second leaf spring. When an operator pulls up or presses the operation button, the first and second leaf springs elastically contact the fixed contact to close the circuit or separate from the fixed contact to open the circuit.

With respect to the structure and actual operation and application of the above conventional switch devices, some shortcomings exist as follows:

1. In some operation and application conditions, due to long-term use or human factors, the switch case, the operation button or the connection seat is often damaged or broken. According to the structure of the compression springs disposed between the case and the connection seat of the conventional switch device, the compression springs will lose the operation support point or load section for compressing the compression springs or releasing the energy. As a result, the compression springs will fail to truly push the connection seat so that the circuit of the wire connection module cannot be opened. In this case, the switch device will lose its emergent brakeage function and cannot emergently open the circuit.

2. In the conventional switch device, according to the structure of the first and second leaf springs in cooperation with the finger-like members disposed on the base seat (and/or assembled with the spiral springs), the first and second leaf springs must be designed with a specific structure so as to provide elastic action force. For example, one end of the first leaf spring is formed with a bent section and a movable contact. The back face of the movable contact is connected with the second leaf spring in reverse direction. The second leaf spring is formed with a U-shaped body structure including a bent section and a movable plate extending in a direction to the first leaf spring in adaptation to the finger-like member.

As well known by those who are skilled in this field, the structures and the bending and punching operation of the first and second leaf springs are complicated. This is unbeneficial to lowering the manufacturing cost.

In structure and actual operation and application, the conventional switch device has another problem that in order to increase the elastic action force or motional range of the first and second leaf springs, the first leaf spring is especially made of a thinner band-like plate and formed with a hollow section structure. However, such structural form will lower the electro-conductive performance of the first leaf spring. This is not what we expect.

To speak representatively, the above references reveal some shortcomings of the case and the operation body and the wire connection module or the relevant connection components of the conventional switch device in use and structural design. In case the assembling structures and the application conditions of the switch device, the wire connection module and the relevant components are redesigned to be different from the conventional switch device, the use form of the switch device can be changed to enhance the application effect thereof. For example, in the condition that the structure is simplified and the operation is facilitated, the redesign should include the following issues:

1. The structural form of the conventional switch device that the compression springs are disposed between the case and the connection seat must be eliminated. In this case, the shortcoming of the conventional switch device that the structure of the switch device is often damaged or broken so that the compression springs assembled with the wire connection module cannot open the circuit can be improved.

2. The complicated structural form of the first and second leaf springs of the conventional switch device should be eliminated or solved. In this case, the shortcoming of the conventional switch device that in order to provide the elastic effect, the electro-conductive performance of the first leaf spring is lowered can be improved.

SUMMARY OF THE INVENTION

It is therefore a primary object of the present invention to provide a switch device structure, which provides an ensuring system to improve the shortcoming of the conventional switch device that the circuit cannot be securely opened. The switch device structure includes a main body and an operation button assembled with the main body. The main body defines a chamber in which a base seat is assembled. An operation body and a wire connection module are disposed on the base seat. The base seat is formed with a cavity in which an elastic unit is mounted. The elastic unit includes a fixed section and a free section. In response to the move of the operation body and with the fixed section serving as a fulcrum, the free section of the elastic unit can push a second contact of the wire connection module into contact with a first contact to close the circuit or away from the first contact to open the circuit.

It is a further object of the present invention to provide the above switch device structure in which the fixed section of the elastic unit includes a first section and a second section connected with the first section and perpendicularly bent from the first section. A tail end of the second section is fixed on the base seat. The free section of the elastic unit includes a first section, a second section connected with the second section and a third section connected with the second section and perpendicularly bent from the second section. The first and second sections contain therebetween an angle, whereby the second section is inclined from the first section to provide an action force. Therefore, in response to the move of the operation body, the third section can push a second contact of the wire connection module into contact with a first contact to close the circuit or away from the first contact to open the circuit.

The present invention can be best understood through the following description and accompanying drawings, wherein:

DETAILED DESCRIPTION OF THE PREFERRED EMBODIMENTS

Figure 1:
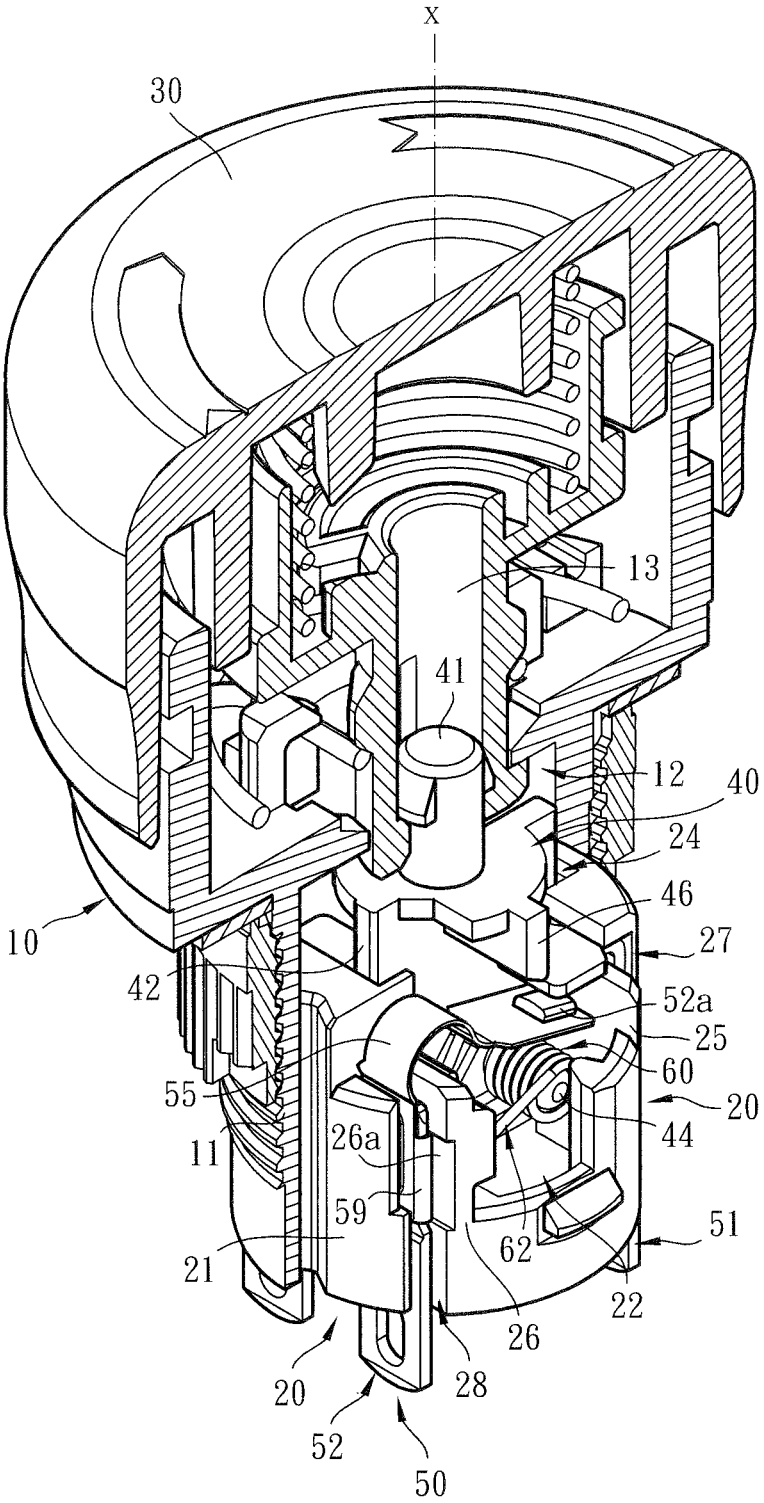
FIG. 1 is a perspective sectional view of the present invention, showing the structure of the assembly of the operation button, the main body, the operation body, the base seat, the wire connection module and the elastic unit of the present invention.
Figure 2:
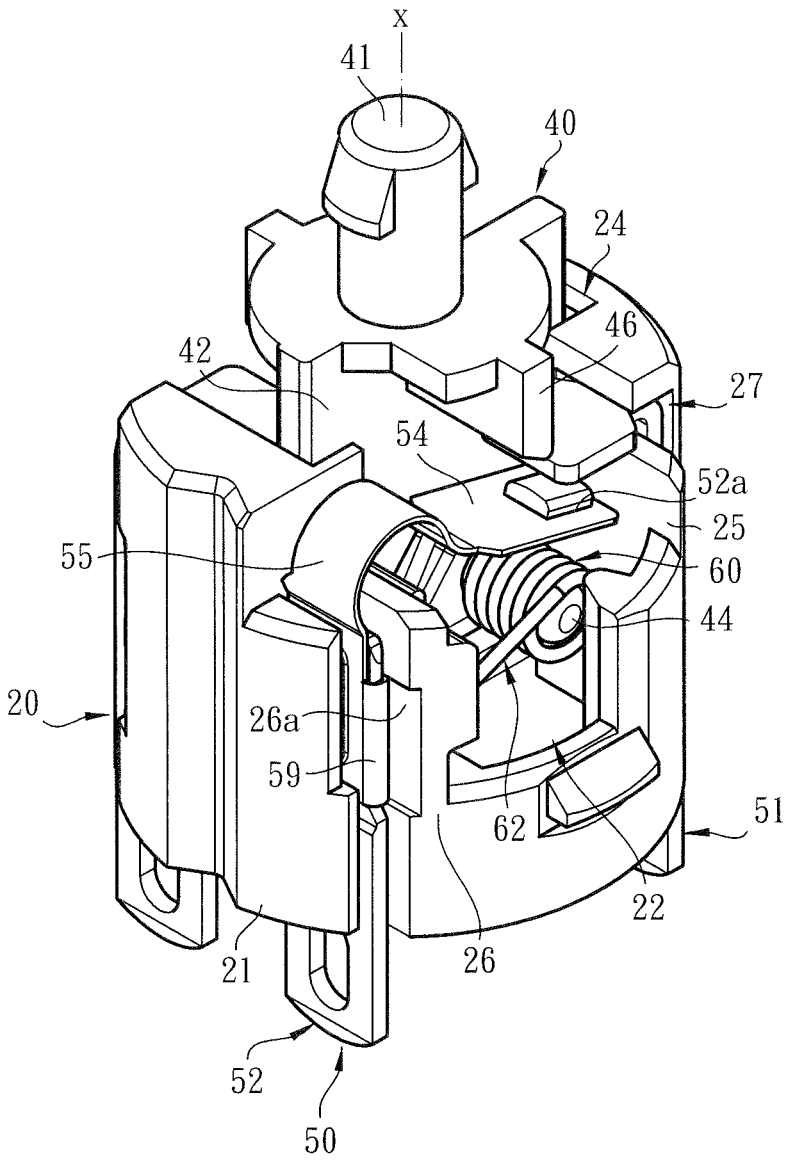
FIG. 2 is a perspective view of a part of the present invention according to FIG. 1, showing the structure of the assembly of the operation body, the base seat, the wire connection module and the elastic unit of the present invention.
Figure 3:
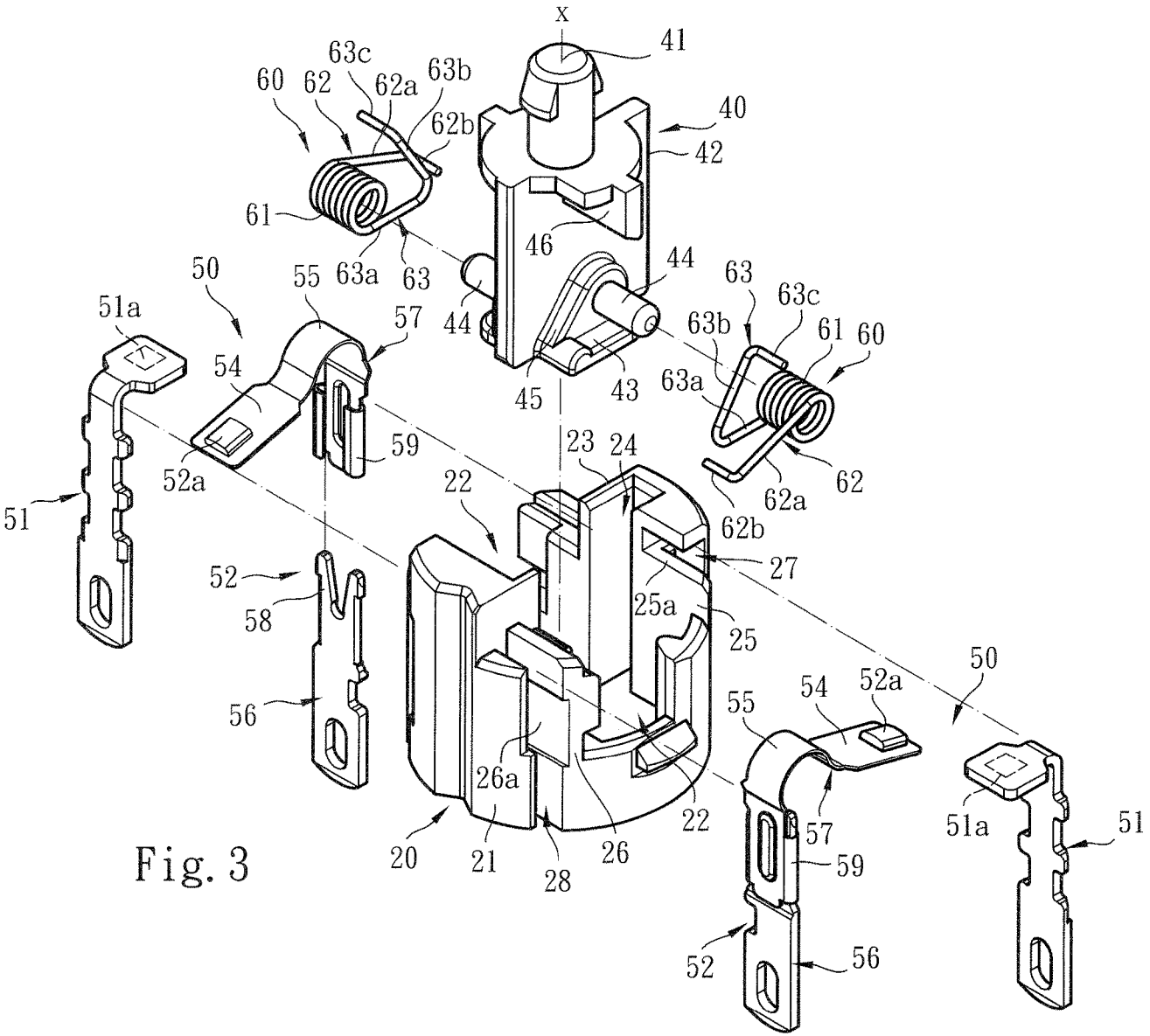
FIG. 3 is a perspective exploded view according to FIG. 2.

Please refer to FIGS. 1, 2 and 3. The switch device structure of the present invention includes a main body 10 and a base seat 20 assembled with the main body 10. The main body 10 is a cylindrical body structure having a base section 11. The main body 10 is defined with an axial reference axis X. An operation (push) button 30 is disposed in the main body 10. The operation button 30 is permitted to freely move and/or rotate within the main body 10 along the axial reference axis X. The relevant cooperative structures of the main body 10 and the operation button 30 pertain to prior art and thus will not be specifically described hereinafter.

In a preferred embodiment, the main body 10 (and/or the base section 11) defines a chamber 12 in which the base seat 20 and an operation body 40 are assembled. To speak specifically, the base seat 20 is a substantially cylindrical body structure having a wall 21 and at least one cavity 22 for assembling with the operation body 40 and an elastic unit 60. As shown in the drawings, a partitioning wall 23 is disposed in the middle section of the base seat 20, whereby the base seat 20 is partitioned into two symmetrical cavities 22 on two sides. Only the cavity 22 on one single side of the base seat 20 will be described hereinafter to facilitate illustration.

FIGS. 1, 2 and 3 also show that a section of the base seat 20 in adjacency to the partitioning wall 23 and the wall 21 together define a subsidiary cavity 24 in communication with the cavity 22. The operation body 40 is mounted in the cavity 22 and the subsidiary cavity 24 and is permitted to freely move within the cavity 22 and/or the subsidiary cavity 24 along the axial reference axis X. In this embodiment, a first subsidiary wall 25 and a second subsidiary wall 26 are disposed on the base seat 20 in adjacency to the cavity 22. A first assembling section 27 and a second assembling section 28 are respectively defined between the first and second subsidiary walls 25, 26 and the wall 21 for assembling with the wire connection module 50.

As shown in the drawings, the wire connection module 50 includes multiple contact arms classified into first contact arm 51 and second contact arm 52 respectively mounted on the first and second assembling sections 27, 28. The first contact arm 51 has a first contact 51*a* (or so-called fixed contact). The first contact 51*a* extends through a notch 25*a* of the first subsidiary wall 25 into the cavity 22. The second contact arm 52 has a free section 54 and a second contact 52*a* (or so-called movable contact) disposed on the free section 54. The free section 54 and the second contact 52*a* pass over the second subsidiary wall 26 and extend into the cavity 22. In addition, the second contact 52*a* extends to reach the position of the first contact 51*a*, whereby the first and second contacts 51*a*, 52*a* are positioned in an upper position and a lower position as shown in the drawings.

In a preferred embodiment, the second contact arm 52 has a bight section 55 connected with the free section 54. The bight section 55 serves to enhance the elastic effect and/or motional range of the free section 54.

In a preferred embodiment, in order to make the second contact arm 52 have a more idealist electro-conductive performance and higher rigidity, the second contact arm 52 is a two-piece structure having a first section 56 and a second section 57. The first section 56 is selectively made of a material with greater rigidity or hardness (or higher than the rigidity or hardness of the second section 57), such as iron, steel or the like material. The second section 57 is selectively made of a material with higher electro-conductive performance (or higher than the electro-conductive performance of the first section 56), such as brass, copper or the like material.

As shown in the drawings, the first section 56 has a forked head end 58 for assembling with a holding edge 59 of the second section 57 to form an integrated structure. The second subsidiary wall 26 (or the second assembling section 28) is formed with a recessed insertion section 26*a* corresponding to the head end 58 of the first section and the holding edge 59 of the second section for helping in locating the second contact arm 52.

As shown in FIGS. 1, 2 and 3, the operation body 40 includes a head section 41 and a belly section 42 connected with the head section 41. The head section 41 is confined in a shaft room 13 of the main body 10 and permitted to (up and down) reciprocally move within the shaft room 13. The belly section 42 substantially is a plate body structure mounted in the subsidiary cavity 24 of the base seat and permitted to (up and down) reciprocally move within the subsidiary cavity 24.

In a preferred embodiment, the belly section 42 has a rest section 43 and a stake 44 transversely protruding from the belly section 42 for arranging the elastic unit 60 thereon. In order to reduce the frictional force or resistance against the move of the elastic unit 60 in response to the operation body 40, a raised section 45 is disposed on the belly section 42 and connected with the rest section 43 and the stake 44. Therefore, when the elastic unit 60 moves, the elastic unit 60 will not contact or abrade the belly section 42. In addition, the operation body 40 has a protruding arm 46 protruding from the belly section 42 and extending to a lower side of the drawing.

As shown in the drawings, the elastic unit 60 is a torque spring having a base section 61 formed with at least one arched structure or multiple loop structures wound on the stake 44 of the operation body 40. A fixed section 62 and a free section 63 respectively extend from two ends of the base section 61. The fixed section 62 includes a first section 62*a* and a second section 62*b* connected with the first section 62*a*. The first section 62*a* of the fixed section slightly obliquely extends from an upper side of the drawing to a lower side thereof. The second section 62*b* of the fixed section is perpendicularly bent from the first section 62*a* to the free section 63. The second section 62*b* of the fixed section is fixed on the base seat 20 (or the second subsidiary wall 26).

The free section 63 includes a first section 63*a*, a second section 63*b* connected with the first section 63*a* and a third section 63*c* connected with the second section 63*b*. The first section 63*a* of the free section horizontally extends to contact the rest section 43 of the operation body 40 for providing a support effect as shown in the drawing. The first and second sections 63*a*, 63*b* of the free section contain an angle, whereby the second section 63*b* of the free section is inclined from the first section 63*a* so as to provide an action force, whereby in response to the move of the operation body 40, the third section 63*c* of the free section can push the second contact 52*a* of the second contact arm 52 into contact with the first contact 51*a* to close the circuit or away from the second contact arm 52 to open the circuit.

In this embodiment, the angle contained between the first and second sections 63*a*, 63*b* of the free section can be an acute angle, a right angle or an obtuse angle. The third section 63*c* of the free section is perpendicularly bent from the second section 63*b* to the fixed section 62. The third section 63*c* extends to form an action section for pushing the free section 54 of the second contact arm as shown in FIG. 4.

Figure 4:
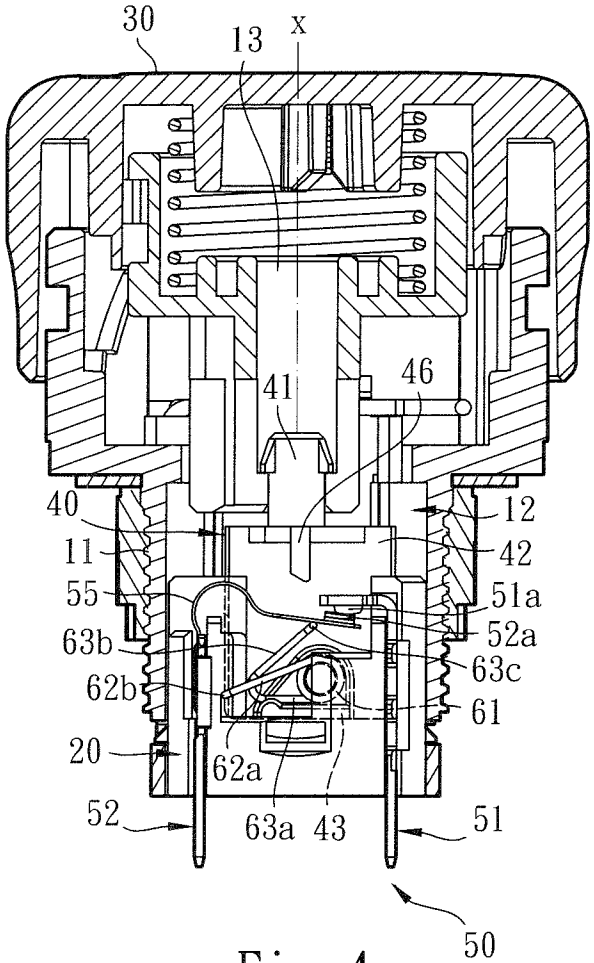
FIG. 4 is a plane sectional view of the present invention according to FIG. 1, showing that the elastic unit is assembled with the wire connection module to close the circuit.

Please refer to FIG. 4, which shows that the operation body 40 and the elastic unit 60 are assembled with the wire connection module 50 to close the circuit of the switch device. As shown in the drawing, when the circuit of the switch device is in a closed state, the operation body 40 is positioned in a first position, where with the second section 62*b* of the fixed section 62 of the elastic unit 60 serving as a support point, the rest section 43 of the operation body 40 cooperates with the first section 63*a* of the elastic unit 60 to make the elastic unit 60 store energy in response to the move of the operation body 40. In this case, the third section 63*c* of the free section pushes the second contact 52*a* of the free section 54 of the second contact arm into contact with the first contact 51*a* of the first contact arm 51.

Figure 5:
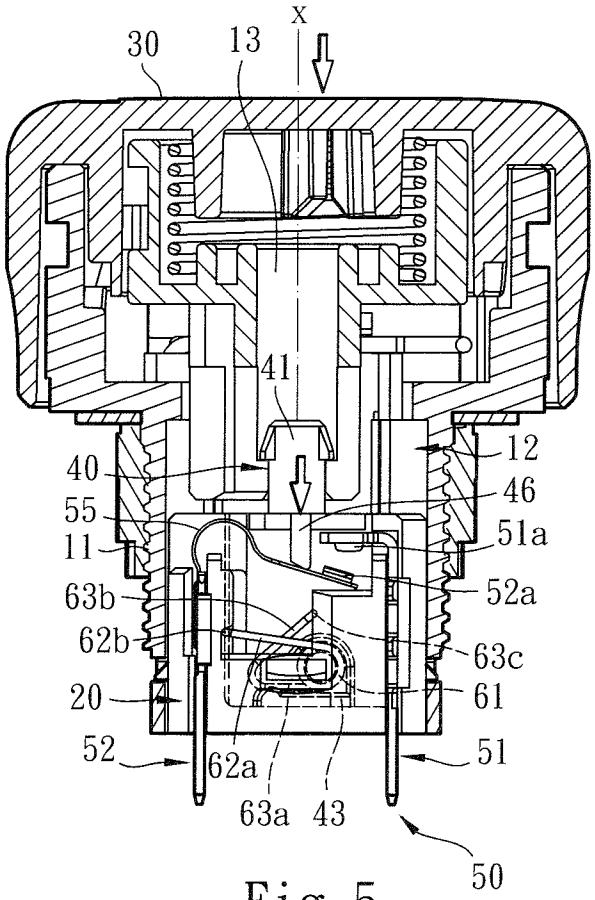
FIG. 5 is another plane sectional view of the present invention, showing that an operator presses the operation button to drive the operation body to move downward and open the circuit of the wire connection module and showing the cooperative structures of the operation body, the wire connection module and the elastic unit.

Please refer to FIG. 5. When an operator presses down the operation button 30 under an emergent condition, the operation body 40 is driven to move from the first position to the lower side of the drawing (or defined as a second position). At this time, in response to the move of the operation body 40, the elastic unit 60 (or the third section 63*c* of the free section) releases the previously stored energy with the fixed section 62 (or the second section 62*b*) serving as a fulcrum. Under such circumstance, the free section 54 of the second contact arm is released from the push of the third section 63*c* of the free section, whereby the second contact 52*a* is separated from the first contact 51*a* of the first contact arm 51 to open the circuit.

As shown in the drawings, the protruding arm 46 of the operation body 40 ensures that the second contact 52*a* of the free section 54 of the second contact arm is separated from the first contact 51*a*.

To speak representatively, in the condition that the operation is facilitated, in comparison with the conventional switch device, the switch device structure of the present invention has the following advantages:

1. The main body 10, the base seat 20, the operation body 40, the wire connection module 50 and the elastic unit 60 and the relevant cooperative structures have been redesigned in use and operation form to be different from the conventional switch device. For example, the main body 10 is assembled with the base seat 20. A partitioning wall 23 is disposed in the base seat 20 to partition the base seat 20 into two symmetrical cavities 22 on two sides. The partitioning wall 23 and the wall 21 of the base seat 20 together define a subsidiary cavity 24 in communication with the cavity 22 for receiving the operation body 40 and the elastic unit 60. The base seat 20 is formed with a first subsidiary wall 25, a first assembling section 27, a second subsidiary wall 26 and a second assembling section 28 for securely mounting the wire connection module 50. The rest section 43 and the stake 44 are disposed on the belly section 42 of the operation body 40 for assembling with the elastic unit 60. The elastic unit 60 includes a fixed section 62 and a free section 63. The fixed section 62 includes a first section 62*a* and a second section 62*b*. The free section 63 includes a first section 63*a*, a second section 63*b* and a third section 63*c*. The third section 63*c* of the free section can push the second contact 52*a* of the second contact arm 52 of the wire connection module into contact with the first contact 51*a* to close the circuit or away from the second contact arm 52 to open the circuit.

2. The operation body 40 and the elastic unit 60 are received in and assembled with the cavity 22 and the subsidiary cavity 24 of the base seat 20. The elastic unit 60 is moved with the base seat 20 or the interior of the cavity 22 serving as an operation support point. Such structural form obviously eliminates the technical form of the conventional switch device that the compression springs are disposed between the case and the connection seat (or the base seat) as the motional fulcrum of the compression springs. In this case, the possibility of the condition of the conventional switch device that the switch device structure is apt to be damaged, broken or separated to make the compression springs lose their support point so that the wire connection module cannot be controlled to open the circuit can be minimized.

3. Especially, the base seat 20 is formed with the cavity 22 for receiving the elastic unit 60 so that the elastic unit 60 can more securely push or separate from the wire connection module 50. Such structure and technique obviously improves the shortcomings of the conventional switch device that the structural form of the first and second leaf springs is complicated and the first leaf spring is formed with a hollow section for enhancing the elastic effect so that the electro-conductive performance is lowered.

In conclusion, the switch device structure of the present invention is effective and different from the conventional switch device in space form. The switch device structure of the present invention is inventive, greatly advanced and advantageous over the conventional switch device.

The above embodiments are only used to illustrate the present invention, not intended to limit the scope thereof. Many modifications of the above embodiments can be made without departing from the spirit of the present invention.

What is claimed is:

1. A switch device structure comprising a main body and an operation button assembled with the main body, the main body being defined with an axial reference axis, the main body defining a base section and a chamber in which the base seat is mounted, an operation body and a wire connection module being disposed on the base seat, the operation body being reciprocally movable along the axial reference axis, the wire connection module including multiple contact arms classified into first contact arm and second contact arm, the first contact arm having a first contact, the second contact arm having a second contact, the base seat having a wall and at least one cavity in which an elastic unit is mounted, the elastic unit including a base section, a fixed section and a free section respectively extending from two ends of the base section, the fixed section of the elastic unit being fixed on the base seat, whereby in response to the move of the operation body and with the fixed section serving as a fulcrum, the free section of the elastic unit can push the second contact of the second contact arm into contact with the first contact of the first contact arm to close the circuit or separate from the second contact arm to open the circuit.

2. The switch device structure as claimed in claim 1, wherein the main body is a cylindrical body structure having a base section, the base seat being a cylindrical body structure having a wall and a partitioning wall, a section of the base seat in adjacency to the partitioning wall and the wall together defining a subsidiary cavity in communication with the cavity, the operation body being mounted in the cavity and the subsidiary cavity.

3. The switch device structure as claimed in claim 2, wherein the partitioning wall is disposed in the middle section of the base seat, whereby the base seat is partitioned into two symmetrical cavities on two sides.

4. The switch device structure as claimed in claim 1, wherein a first subsidiary wall and a second subsidiary wall are disposed on the base seat in adjacency to the cavity, the first assembling section and the second assembling section being respectively defined between the first and second subsidiary walls and the wall, the first assembling section being assembled with the first contact arm, the second assembling section being assembled with the second contact arm, the first contact of the first contact arm extending through a notch of the first subsidiary wall into the cavity, the second contact arm having a free section on which the second contact is disposed and a bight section connected with the free section, the free section and the second contact passing over the second subsidiary wall and extending into the cavity, whereby the second contact extends to reach the position of the first contact.

5. The switch device structure as claimed in claim 2, wherein a first subsidiary wall and a second subsidiary wall are disposed on the base seat in adjacency to the cavity, the first assembling section and the second assembling section being respectively defined between the first and second subsidiary walls and the wall, the first assembling section being assembled with the first contact arm, the second assembling section being assembled with the second contact arm, the first contact of the first contact arm extending through a notch of the first subsidiary wall into the cavity, the second contact arm having a free section on which the second contact is disposed and a bight section connected with the free section, the free section and the second contact passing over the second subsidiary wall and extending into the cavity, whereby the second contact extends to reach the position of the first contact.

6. The switch device structure as claimed in claim 3, wherein a first subsidiary wall and a second subsidiary wall are disposed on the base seat in adjacency to the cavity, the first assembling section and the second assembling section being respectively defined between the first and second subsidiary walls and the wall, the first assembling section being assembled with the first contact arm, the second assembling section being assembled with the second contact arm, the first contact of the first contact arm extending through a notch of the first subsidiary wall into the cavity, the second contact arm having a free section on which the second contact is disposed and a bight section connected with the free section, the free section and the second contact passing over the second subsidiary wall and extending into the cavity, whereby the second contact extends to reach the position of the first contact.

7. The switch device structure as claimed in claim 1, wherein the second contact arm is a two-piece structure having a first section and a second section, the first section being selectively made of a material with hardness greater than the hardness of the second section, the second section being selectively made of a material with electro-conductivity higher than the electro-conductivity of the first section, the first section having a head end for assembling with a holding edge of the second section to form an integrated structure.

8. The switch device structure as claimed in claim 2, wherein the second contact arm is a two-piece structure having a first section and a second section, the first section being selectively made of a material with hardness greater than the hardness of the second section, the second section being selectively made of a material with electro-conductivity higher than the electro-conductivity of the first section, the first section having a head end for assembling with a holding edge of the second section to form an integrated structure.

9. The switch device structure as claimed in claim 3, wherein the second contact arm is a two-piece structure having a first section and a second section, the first section being selectively made of a material with hardness greater than the hardness of the second section, the second section being selectively made of a material with electro-conductivity higher than the electro-conductivity of the first section, the first section having a head end for assembling with a holding edge of the second section to form an integrated structure.

10. The switch device structure as claimed in claim 4, wherein the second contact arm is a two-piece structure having a first section and a second section, the first section being selectively made of a material with hardness greater than the hardness of the second section, the second section being selectively made of a material with electro-conductivity higher than the electro-conductivity of the first section, the first section having a head end for assembling with a holding edge of the second section to form an integrated structure.

11. The switch device structure as claimed in claim 5, wherein the second contact arm is a two-piece structure having a first section and a second section, the first section being selectively made of a material with hardness greater than the hardness of the second section, the second section being selectively made of a material with electro-conductivity higher than the electro-conductivity of the first section, the first section having a head end for assembling with a holding edge of the second section to form an integrated structure.

12. The switch device structure as claimed in claim 6, wherein the second contact arm is a two-piece structure having a first section and a second section, the first section being selectively made of a material with hardness greater than the hardness of the second section, the second section being selectively made of a material with electro-conductivity higher than the electro-conductivity of the first section, the first section having a head end for assembling with a holding edge of the second section to form an integrated structure.

13. The switch device structure as claimed in claim 1, wherein the operation body includes a head section and a belly section connected with the head section, the head section being confined in a shaft room of the main body and permitted to reciprocally move within the shaft room, the belly section substantially being a plate body structure having a rest section and a stake transversely protruding from the belly section for arranging the elastic unit thereon, a raised section being disposed on the belly section and connected with the rest section and the stake, the base section of the elastic unit being formed with an arched structure or multiple loop structures wound on the stake of the operation body, the operation body having a protruding arm protruding from the belly section and extending to a lower side.

14. The switch device structure as claimed in claim 4, wherein the operation body includes a head section and a belly section connected with the head section, the head section being confined in a shaft room of the main body and permitted to reciprocally move within the shaft room, the belly section substantially being a plate body structure having a rest section and a stake transversely protruding from the belly section for arranging the elastic unit thereon, a raised section being disposed on the belly section and connected with the rest section and the stake, the base section of the elastic unit being formed with an arched structure or multiple loop structures wound on the stake of the operation body, the operation body having a protruding arm protruding from the belly section and extending to a lower side.

15. The switch device structure as claimed in claim 7, wherein the operation body includes a head section and a belly section connected with the head section, the head section being confined in a shaft room of the main body and permitted to reciprocally move within the shaft room, the belly section substantially being a plate body structure having a rest section and a stake transversely protruding from the belly section for arranging the elastic unit thereon, a raised section being disposed on the belly section and connected with the rest section and the stake, the base section of the elastic unit being formed with an arched structure or multiple loop structures wound on the stake of the operation body, the operation body having a protruding arm protruding from the belly section and extending to a lower side.

16. The switch device structure as claimed in claim 10, wherein the operation body includes a head section and a belly section connected with the head section, the head section being confined in a shaft room of the main body and permitted to reciprocally move within the shaft room, the belly section substantially being a plate body structure having a rest section and a stake transversely protruding from the belly section for arranging the elastic unit thereon, a raised section being disposed on the belly section and connected with the rest section and the stake, the base section of the elastic unit being formed with an arched structure or multiple loop structures wound on the stake of the operation body, the operation body having a protruding arm protruding from the belly section and extending to a lower side.

17. The switch device structure as claimed in claim 2, wherein the operation body includes a head section and a belly section connected with the head section, the head section being confined in a shaft room of the main body and permitted to reciprocally move within the shaft room, the belly section substantially being a plate body structure mounted in the subsidiary cavity of the base seat and permitted to reciprocally move within the subsidiary cavity, the belly section having a rest section and a stake transversely protruding from the belly section, the base section of the elastic unit being formed with an arched structure or multiple loop structures wound on the stake of the operation body, a raised section being disposed on the belly section and connected with the rest section and the stake, the operation body having a protruding arm protruding from the belly section and extending to a lower side.

18. The switch device structure as claimed in claim 3, wherein the operation body includes a head section and a belly section connected with the head section, the head section being confined in a shaft room of the main body and permitted to reciprocally move within the shaft room, the belly section substantially being a plate body structure mounted in the subsidiary cavity of the base seat and permitted to reciprocally move within the subsidiary cavity, the belly section having a rest section and a stake transversely protruding from the belly section, the base section of the elastic unit being formed with an arched structure or multiple loop structures wound on the stake of the operation body, a raised section being disposed on the belly section and connected with the rest section and the stake, the operation body having a protruding arm protruding from the belly section and extending to a lower side.

19. The switch device structure as claimed in claim 5, wherein the operation body includes a head section and a belly section connected with the head section, the head section being confined in a shaft room of the main body and permitted to reciprocally move within the shaft room, the belly section substantially being a plate body structure mounted in the subsidiary cavity of the base seat and permitted to reciprocally move within the subsidiary cavity, the belly section having a rest section and a stake transversely protruding from the belly section, the base section of the elastic unit being formed with an arched structure or multiple loop structures wound on the stake of the operation body, a raised section being disposed on the belly section and connected with the rest section and the stake, the operation body having a protruding arm protruding from the belly section and extending to a lower side.

20. The switch device structure as claimed in claim 6, wherein the operation body includes a head section and a belly section connected with the head section, the head section being confined in a shaft room of the main body and permitted to reciprocally move within the shaft room, the belly section substantially being a plate body structure mounted in the subsidiary cavity of the base seat and permitted to reciprocally move within the subsidiary cavity, the belly section having a rest section and a stake transversely protruding from the belly section, the base section of the elastic unit being formed with an arched structure or multiple loop structures wound on the stake of the operation body, a raised section being disposed on the belly section and connected with the rest section and the stake, the operation body having a protruding arm protruding from the belly section and extending to a lower side.

21. The switch device structure as claimed in claim 8, wherein the operation body includes a head section and a belly section connected with the head section, the head section being confined in a shaft room of the main body and permitted to reciprocally move within the shaft room, the belly section substantially being a plate body structure mounted in the subsidiary cavity of the base seat and permitted to reciprocally move within the subsidiary cavity, the belly section having a rest section and a stake transversely protruding from the belly section, the base section of the elastic unit being formed with an arched structure or multiple loop structures wound on the stake of the operation body, a raised section being disposed on the belly section and connected with the rest section and the stake, the operation body having a protruding arm protruding from the belly section and extending to a lower side.

22. The switch device structure as claimed in claim 9, wherein the operation body includes a head section and a belly section connected with the head section, the head section being confined in a shaft room of the main body and permitted to reciprocally move within the shaft room, the belly section substantially being a plate body structure mounted in the subsidiary cavity of the base seat and permitted to reciprocally move within the subsidiary cavity, the belly section having a rest section and a stake transversely protruding from the belly section, the base section of the elastic unit being formed with an arched structure or multiple loop structures wound on the stake of the operation body, a raised section being disposed on the belly section and connected with the rest section and the stake, the operation body having a protruding arm protruding from the belly section and extending to a lower side.

23. The switch device structure as claimed in claim 11, wherein the operation body includes a head section and a belly section connected with the head section, the head section being confined in a shaft room of the main body and permitted to reciprocally move within the shaft room, the belly section substantially being a plate body structure mounted in the subsidiary cavity of the base seat and permitted to reciprocally move within the subsidiary cavity, the belly section having a rest section and a stake transversely protruding from the belly section, the base section of the elastic unit being formed with an arched structure or multiple loop structures wound on the stake of the operation body, a raised section being disposed on the belly section and connected with the rest section and the stake, the operation body having a protruding arm protruding from the belly section and extending to a lower side.

24. The switch device structure as claimed in claim 12, wherein the operation body includes a head section and a belly section connected with the head section, the head section being confined in a shaft room of the main body and permitted to reciprocally move within the shaft room, the belly section substantially being a plate body structure mounted in the subsidiary cavity of the base seat and permitted to reciprocally move within the subsidiary cavity, the belly section having a rest section and a stake transversely protruding from the belly section, the base section of the elastic unit being formed with an arched structure or multiple loop structures wound on the stake of the operation body, a raised section being disposed on the belly section and connected with the rest section and the stake, the operation body having a protruding arm protruding from the belly section and extending to a lower side.

25. The switch device structure as claimed in claim 1, wherein the elastic unit is a torque spring, the base section of the elastic unit being formed with an arched structure or multiple loop structures, the fixed section of the elastic unit including a first section and a second section connected with the first section, the first section of the fixed section obliquely extending from an upper side to a lower side, the second section of the fixed section being perpendicularly bent from the first section to the free section, the second section of the fixed section being fixed on the base seat, the free section including a first section, a second section connected with the first section and a third section connected with the second section, the first section of the free section horizontally extending, the first and second sections of the free section containing an angle, whereby the second section of the free section being inclined from the first section so as to provide an action force, whereby the third section of the free section can push the second contact of the second contact arm into contact with the first contact, the angle contained between the first and second sections of the free section being selected from a group consisting of an acute angle, a right angle and an obtuse angle.

26. The switch device structure as claimed in claim 4, wherein the elastic unit is a torque spring, the base section of the elastic unit being formed with an arched structure or multiple loop structures, the fixed section of the elastic unit including a first section and a second section connected with the first section, the first section of the fixed section obliquely extending from an upper side to a lower side, the second section of the fixed section being perpendicularly bent from the first section to the free section, the second section of the fixed section being fixed on the base seat, the free section including a first section, a second section connected with the first section and a third section connected with the second section, the first section of the free section horizontally extending, the first and second sections of the free section containing an angle, whereby the second section of the free section being inclined from the first section so as to provide an action force, whereby the third section of the free section can push the second contact of the second contact arm into contact with the first contact, the angle contained between the first and second sections of the free section being selected from a group consisting of an acute angle, a right angle and an obtuse angle.

27. The switch device structure as claimed in claim 7, wherein the elastic unit is a torque spring, the base section of the elastic unit being formed with an arched structure or multiple loop structures, the fixed section of the elastic unit including a first section and a second section connected with the first section, the first section of the fixed section obliquely extending from an upper side to a lower side, the second section of the fixed section being perpendicularly bent from the first section to the free section, the second section of the fixed section being fixed on the base seat, the free section including a first section, a second section connected with the first section and a third section connected with the second section, the first section of the free section horizontally extending, the first and second sections of the free section containing an angle, whereby the second section of the free section being inclined from the first section so as to provide an action force, whereby the third section of the free section can push the second contact of the second contact arm into contact with the first contact, the angle contained between the first and second sections of the free section being selected from a group consisting of an acute angle, a right angle and an obtuse angle.

28. The switch device structure as claimed in claim 2, wherein the elastic unit is a torque spring, the base section of the elastic unit being formed with an arched structure or multiple loop structures, the fixed section of the elastic unit including a first section and a second section connected with the first section, the first section of the fixed section obliquely extending from an upper side to a lower side, the second section of the fixed section being perpendicularly bent from the first section to the free section, the second section of the fixed section being fixed on the base seat, the free section including a first section, a second section connected with the first section and a third section connected with the second section, the first section of the free section horizontally extending, the first and second sections of the free section containing an angle, whereby the second section of the free section being inclined from the first section so as to provide an action force, whereby the third section of the free section can push the second contact of the second contact arm into contact with the first contact, the angle contained between the first and second sections of the free section being selected from a group consisting of an acute angle, a right angle and an obtuse angle.

29. The switch device structure as claimed in claim 3, wherein the elastic unit is a torque spring, the base section of the elastic unit being formed with an arched structure or multiple loop structures, the fixed section of the elastic unit including a first section and a second section connected with the first section, the first section of the fixed section obliquely extending from an upper side to a lower side, the second section of the fixed section being perpendicularly bent from the first section to the free section, the second section of the fixed section being fixed on the base seat, the free section including a first section, a second section connected with the first section and a third section connected with the second section, the first section of the free section horizontally extending, the first and second sections of the free section containing an angle, whereby the second section of the free section being inclined from the first section so as to provide an action force, whereby the third section of the free section can push the second contact of the second contact arm into contact with the first contact, the angle contained between the first and second sections of the free section being selected from a group consisting of an acute angle, a right angle and an obtuse angle.

30. The switch device structure as claimed in claim 15, wherein the elastic unit is a torque spring, the base section of the elastic unit being formed with an arched structure or multiple loop structures, the fixed section of the elastic unit including a first section and a second section connected with the first section, the first section of the fixed section obliquely extending from an upper side to a lower side, the second section of the fixed section being perpendicularly bent from the first section to the free section, the second section of the fixed section being fixed on the base seat, the free section including a first section, a second section connected with the first section and a third section connected with the second section, the first section of the free section horizontally extending to contact the rest section of the operation body, the first and second sections of the free section containing an angle, whereby the second section of the free section being inclined from the first section so as to provide an action force, whereby the third section of the free section can push the second contact of the second contact arm into contact with the first contact, the angle contained between the first and second sections of the free section being selected from a group consisting of an acute angle, a right angle and an obtuse angle.

31. The switch device structure as claimed in claim 17, wherein the elastic unit is a torque spring, the base section of the elastic unit being formed with an arched structure or multiple loop structures, the fixed section of the elastic unit including a first section and a second section connected with the first section, the first section of the fixed section obliquely extending from an upper side to a lower side, the second section of the fixed section being perpendicularly bent from the first section to the free section, the second section of the fixed section being fixed on the base seat, the free section including a first section, a second section connected with the first section and a third section connected with the second section, the first section of the free section horizontally extending to contact the rest section of the operation body, the first and second sections of the free section containing an angle, whereby the second section of the free section being inclined from the first section so as to provide an action force, whereby the third section of the free section can push the second contact of the second contact arm into contact with the first contact, the angle contained between the first and second sections of the free section being selected from a group consisting of an acute angle, a right angle and an obtuse angle.

32. The switch device structure as claimed in claim 25, wherein the third section of the free section is perpendicularly bent from the second section to the fixed section.

33. The switch device structure as claimed in claim 26, wherein the third section of the free section is perpendicularly bent from the second section to the fixed section.

34. The switch device structure as claimed in claim 27, wherein the third section of the free section is perpendicularly bent from the second section to the fixed section.

35. The switch device structure as claimed in claim 28, wherein the third section of the free section is perpendicularly bent from the second section to the fixed section.

36. The switch device structure as claimed in claim 29, wherein the third section of the free section is perpendicularly bent from the second section to the fixed section.

37. The switch device structure as claimed in claim 30, wherein the third section of the free section is perpendicularly bent from the second section to the fixed section.

38. The switch device structure as claimed in claim 31, wherein the third section of the free section is perpendicularly bent from the second section to the fixed section.

* * * * *